US011619235B2

(12) United States Patent
Laskaris et al.

(10) Patent No.: US 11,619,235 B2
(45) Date of Patent: Apr. 4, 2023

(54) DUAL PRIMING SYSTEM FOR A PUMP

(71) Applicant: Hale Products, Inc., Ocala, FL (US)

(72) Inventors: Michael A. Laskaris, Collegeville, PA (US); David Lamont Miller, Lafayette Hill, PA (US)

(73) Assignee: HALE PRODUCTS, INC., Ocala, FL (US)

( * ) Notice: Subject to any disclaimer, the term of this patent is extended or adjusted under 35 U.S.C. 154(b) by 0 days.

(21) Appl. No.: 16/995,264

(22) Filed: Aug. 17, 2020

(65) Prior Publication Data

US 2022/0049702 A1 Feb. 17, 2022

(51) Int. Cl.

| | |
|---|---|
| ***F04D 9/04*** | (2006.01) |
| ***F04D 7/02*** | (2006.01) |
| ***F04D 15/00*** | (2006.01) |
| ***F04D 9/06*** | (2006.01) |
| ***F04D 13/12*** | (2006.01) |
| *A62C 31/00* | (2006.01) |
| *A62C 27/00* | (2006.01) |

(52) U.S. Cl.

CPC ..... *F04D 9/041* (2013.01); *F04D 7/02* (2013.01); *F04D 9/065* (2013.01); *F04D 13/12* (2013.01); *F04D 15/0005* (2013.01); *F04D 15/0083* (2013.01); *A62C 27/00* (2013.01); *A62C 31/00* (2013.01)

(58) Field of Classification Search

None

See application file for complete search history.

(56) References Cited

U.S. PATENT DOCUMENTS

| | | | | |
|---|---|---|---|---|
| 2,275,500 A * | 3/1942 | Broadhurst | ..... | F04D 9/008 417/80 |
| 2,275,501 A * | 3/1942 | Broadhurst | ..... | F04D 9/045 417/89 |
| 2,275,502 A * | 3/1942 | Broadhurst | ..... | F04D 9/041 417/80 |
| 2,961,968 A * | 11/1960 | Hill | ..... | F04D 9/048 415/167.1 |
| 4,337,830 A | 7/1982 | Eberhardt | | |

(Continued)

FOREIGN PATENT DOCUMENTS

| | | | |
|---|---|---|---|
| CN | 110743120 A * | 2/2020 | |
| JP | H02150581 A | 6/1990 | |

OTHER PUBLICATIONS

Machine Translation of CN 110743120 (Obtained from USPTO Search, Clarivate Analytics, 2022) (Year: 2022).*

(Continued)

*Primary Examiner* — Essama Omgba
*Assistant Examiner* — Geoffrey S Lee
(74) *Attorney, Agent, or Firm* — Panitch Schwarze Belisario & Nadel LLP

(57) ABSTRACT

A dual priming system connected with a centrifugal pump to evacuate gas therefrom includes a positive displacement pump fluidly connectable with the centrifugal pump and a venturi fluidly connectable with the centrifugal pump in parallel with the positive displacement pump. The dual priming system is operational in a first mode, wherein the positive displacement pump is inactive and the venturi is activated, and a second mode, wherein the positive displacement pump is activated and the venturi is activated.

12 Claims, 1 Drawing Sheet

(56) References Cited

U.S. PATENT DOCUMENTS

| | | | | |
|---|---|---|---|---|
| 5,536,147 | A * | 7/1996 | Lang | F04D 9/041 417/199.2 |
| 5,797,421 | A | 8/1998 | Merrett | |
| 6,152,689 | A * | 11/2000 | Yokota | F04D 15/0005 417/199.2 |
| 6,170,412 | B1 | 1/2001 | Memory et al. | |
| 6,182,588 | B1 | 2/2001 | Bodie et al. | |
| 6,250,889 | B1 * | 6/2001 | Shepard | F04D 9/06 417/89 |
| 6,682,313 | B1 * | 1/2004 | Sulmone | F04F 5/22 417/199.2 |
| 7,287,963 | B2 | 10/2007 | Basora | |
| 7,331,769 | B2 | 2/2008 | Weis et al. | |
| 7,530,404 | B2 | 5/2009 | Lenz, Jr. | |
| 7,845,914 | B2 | 12/2010 | Engelbrecht et al. | |
| 7,874,373 | B2 | 1/2011 | Morrow et al. | |
| 8,075,282 | B2 | 12/2011 | Huegerich et al. | |
| 9,175,686 | B2 | 11/2015 | Johnson | |
| 9,587,641 | B2 | 3/2017 | Mettler et al. | |
| 2004/0177975 | A1 | 9/2004 | Laskaris et al. | |
| 2005/0077057 | A1 | 4/2005 | Laskaris | |
| 2005/0271518 | A1 | 12/2005 | Beyer et al. | |
| 2006/0207659 | A1 | 9/2006 | Shaefer et al. | |
| 2007/0286736 | A1 | 12/2007 | Grady et al. | |
| 2008/0099213 | A1 | 5/2008 | Morrow et al. | |
| 2010/0065286 | A1 | 3/2010 | Hosfield | |
| 2013/0169196 | A1 | 7/2013 | Markham | |
| 2020/0158115 | A1 * | 5/2020 | Mei | F04D 15/0005 |

OTHER PUBLICATIONS

Int'l Search Report and Written Opinion dated Mar. 12, 2021 in Int'l Application No. PCT/US20/57678.

Written Opinion of the International Examining Authority, dated Sep. 2, 2022 in Int'l Application No. PCT/US2021/037905.

Int'l Preliminary Reporton Patentability dated Oct. 20, 2022 in Int'l Application No. PCT/US2021/037905.

* cited by examiner

DUAL PRIMING SYSTEM FOR A PUMP

BACKGROUND OF THE DISCLOSURE

The present disclosure is generally directed to pump priming, and, more particularly, to a dual priming system for a centrifugal pump.

Centrifugal pumps are pumps that convert rotational energy, e.g., from a motor of the pump, into kinetic energy in the form of a moving fluid. Traditional centrifugal pumps require the pump casing to be evacuated of gas and filled with liquid before the pump is operated, in order to function properly. Accordingly, centrifugal pumps require priming systems to supply fluid into the centrifugal pump casing prior to operation thereof.

Generally, centrifugal pumps are primed via a positive displacement pump, such as, for example, an electrically operated positive displacement vacuum pump. In emergency services applications, such as priming a pump on a fire truck, the positive displacement pump is powered by the truck's electrical system. As should be understood, time is of the essence in emergency services applications and a delay in water delivery can be catastrophic. Accordingly, one drawback of such a priming setup is that the power of the positive displacement pump, and, in turn, the priming efficiency of the pump, is limited by the maximum power that can be obtained from the truck's electrical system. Another drawback of such a priming setup is that it is generally loud in operation, rendering verbal communication increasingly challenging, even in light duty priming operations.

Accordingly, it would be advantageous to manufacture a priming system capable of producing greater priming power resulting in faster priming. It would be further advantageous to manufacture a priming system capable of operating in a low noise setting during light duty priming operations.

BRIEF SUMMARY OF THE DISCLOSURE

Briefly stated, one aspect of the present disclosure is directed to a pump system including a centrifugal pump defining a casing with an inlet, an outlet and a vacuum port, where the inlet is fluidly connectable with a liquid containing reservoir. A dual priming system is connected with the vacuum port of the centrifugal pump and configured to evacuate gas from the centrifugal pump casing and draw liquid from the reservoir into the centrifugal pump casing. The dual priming system includes a compressed air source, a positive displacement pump and a venturi. The positive displacement pump has an inlet port and a discharge port, the inlet port being fluidly connected with the vacuum port of the centrifugal pump. The venturi has an inlet port, an outlet port and a suction port, the inlet port being fluidly connectable with the compressed air source and the suction port being fluidly connectable with the vacuum port of the centrifugal pump in parallel with the inlet port of the positive displacement pump. A check valve is positioned upstream and in line with the suction port of the venturi and positioned in parallel with the inlet port of the positive displacement pump. The check valve is oriented in a closed position, substantially preventing fluid flow between the vacuum port of the centrifugal pump and the suction port of the venturi, and is actuatable to an open position, permitting fluid flow from the vacuum port of the centrifugal pump to the suction port of the venturi. A control valve is positioned upstream and in-line with the venturi inlet port. The control valve has an inlet fluidly connected with the compressed air source and an outlet fluidly connected with the venturi inlet port, and is actuatable between a closed position, substantially fluidly disconnecting the compressed air source from the venturi, and an open position, fluidly connecting the compressed air source with the venturi inlet port. The dual priming system is operational in a first mode, wherein the positive displacement pump is inactive and the venturi is activated, and a second mode, wherein the positive displacement pump is activated and the venturi is activated.

Briefly stated, another aspect of the present disclosure is directed to a pump system including a centrifugal pump defining a casing with an inlet, an outlet and a vacuum port, where the inlet is fluidly connectable with a liquid containing reservoir. A dual priming system is connected with the vacuum port of the centrifugal pump and configured to evacuate gas from the centrifugal pump casing and draw liquid from the reservoir into the centrifugal pump casing. The dual priming system includes a compressed air source, a positive displacement pump and a venturi. The positive displacement pump has an inlet port and a discharge port, the inlet port being fluidly connected with the vacuum port of the centrifugal pump. The venturi has an inlet port, an outlet port and a suction port, the inlet port being fluidly connectable with the compressed air source and the suction port being fluidly connectable with the vacuum port of the centrifugal pump in parallel with the inlet port of the positive displacement pump. A first check valve is positioned upstream and in line with the suction port of the venturi and positioned in parallel with the inlet port of the positive displacement pump. The first check valve is oriented in a closed position, substantially preventing fluid flow between the vacuum port of the centrifugal pump and the suction port of the venturi, and is actuatable to an open position, permitting fluid flow from the vacuum port of the centrifugal pump to the suction port of the venturi. A second check valve is positioned upstream and in line with the inlet port of the positive displacement pump and positioned in parallel with the first check valve. The second check valve is oriented in a closed position, substantially preventing fluid flow between the vacuum port of the centrifugal pump and the inlet port of the positive displacement pump, and is actuatable to an open position, permitting fluid flow from the vacuum port of the centrifugal pump to the inlet port of the positive displacement pump. A control valve is positioned upstream and in-line with the venturi inlet port. The control valve has an inlet fluidly connected with the compressed air source and an outlet fluidly connected with the venturi inlet port, and is actuatable between a closed position, substantially fluidly disconnecting the compressed air source from the venturi, and an open position, fluidly connecting the compressed air source with the venturi inlet port. The dual priming system is operational in a first mode, wherein the positive displacement pump is inactive and the venturi is activated, and a second mode, wherein the positive displacement pump is activated and the venturi is activated.

Briefly stated, another aspect of the present disclosure is directed to a method of priming a centrifugal pump defining a casing with an inlet, an outlet and a vacuum port, the inlet being fluidly connectable with a liquid containing reservoir. The method includes the step of connecting a dual priming system with the vacuum port of the centrifugal pump. The dual priming system includes a compressed air source, a positive displacement pump and a venturi. The positive displacement pump has an inlet port and a discharge port, the inlet port being fluidly connectable with the vacuum port of the centrifugal pump. The venturi has an inlet port, an outlet port and a suction port, the inlet port being fluidly connectable with the compressed air source and the suction port being fluidly connectable with the vacuum port of the centrifugal pump in parallel with the inlet port of the positive displacement pump. A first check valve is positioned upstream and in line with the suction port of the venturi and is positioned in parallel with the inlet port of the positive displacement pump. The first check valve is positioned in a closed position, substantially preventing fluid flow between the vacuum port of the centrifugal pump and the suction port of the venturi, and is actuatable to an open position, permitting fluid flow from the vacuum port of the centrifugal pump to the suction port of the venturi. A second check valve is positioned upstream and in line with the inlet port of the positive displacement pump and is positioned in parallel with the first check valve. The second check valve is oriented in a closed position, substantially preventing fluid flow between the vacuum port of the centrifugal pump and the inlet port of the positive displacement pump, and is actuatable to an open position, permitting fluid flow from the vacuum port of the centrifugal pump to the inlet port of the positive displacement pump. A control valve is positioned upstream and in-line with the venturi inlet port, and has an inlet fluidly connected with the compressed air source and an outlet fluidly connected with the venturi inlet port. The control valve is actuatable between a closed position, substantially fluidly disconnecting the compressed air source from the venturi, and an open position, fluidly connecting the compressed air source with the venturi inlet port. The control valve is actuated into the open position thereof to fluidly connect the compressed air source with the venturi inlet port to permit compressed air to flow into the inlet port of the venturi, and, in turn, create a vacuum at the suction port. The first check valve is thus actuated into the open position thereof to fluidly connect the vacuum port of the centrifugal pump with the suction port of the venturi, and, in turn, evacuate gas from the centrifugal pump casing.

BRIEF DESCRIPTION OF THE DRAWINGS

The following detailed description of aspects of the disclosure will be better understood when read in conjunction with the appended drawings. It should be understood, however, that the disclosure is not limited to the precise arrangements and instrumentalities shown. In the drawings.

DETAILED DESCRIPTION OF THE DISCLOSURE

Figure 1:
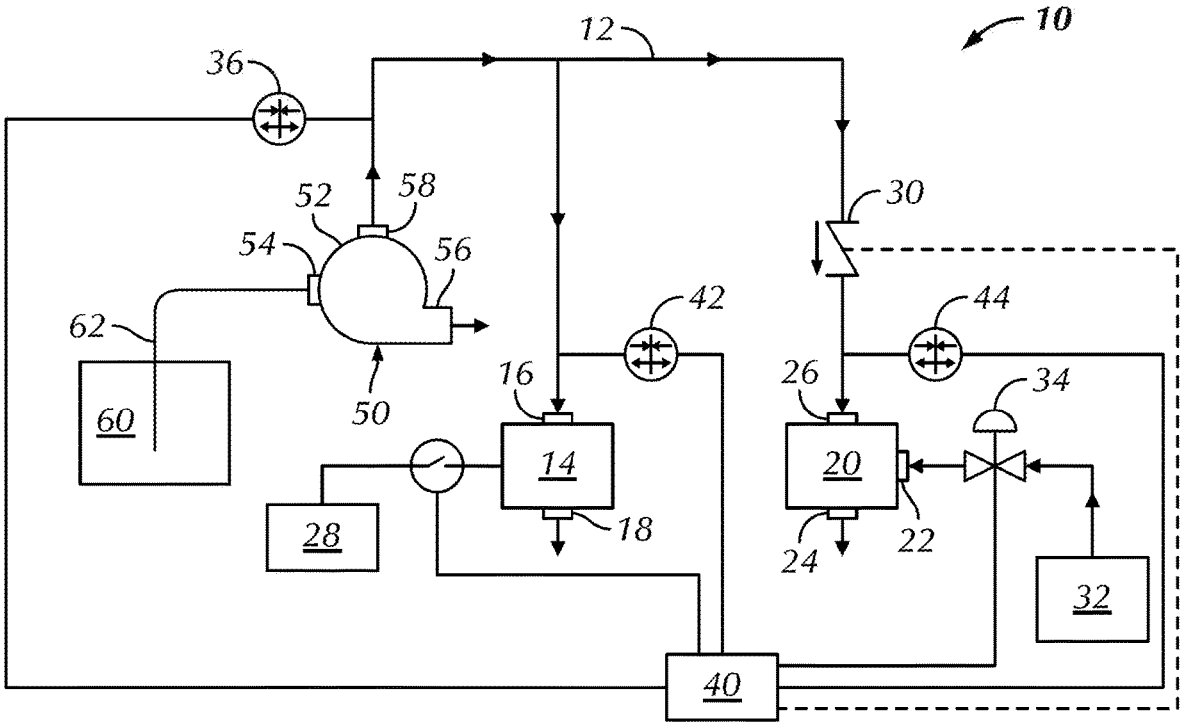
FIG. 1 is a schematic illustration of a dual priming system according to an embodiment of the present disclosure.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the priming system, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to the drawings in detail, wherein like numerals indicate like elements throughout, there is shown in FIG. 1 a schematic diagram of a dual priming system 10 for a centrifugal pump 50, such as on an automotive fire apparatus, e.g., a fire truck, in accordance with an embodiment of the present disclosure. As should be understood, the centrifugal pump 50 defines a casing 52 with an inlet 54, an outlet 56 and a vacuum port 58. The inlet 54 is fluidly connectable with a liquid containing reservoir 60 in a manner well understood by those of ordinary skill in the art, e.g., via at least one intake 62 (see, e.g., two intakes 62 in FIG. 2 connected to the pump 50 via manifold 64) in the form of a line, hose or the like. The liquid, e.g., water, within the reservoir 60 may be static.

The dual priming system 10 is connected with the vacuum port 58 of the centrifugal pump 50 via a vacuum conduit 12 and is configured to evacuate gas from the centrifugal pump casing 52 and draw liquid from the reservoir 60 into the centrifugal pump casing 52. As shown in FIG. 1, the dual priming system 10 includes a positive displacement pump 14 and a venturi 20 fluidly connected with the vacuum port 58 of the centrifugal pump 50 in parallel with one another. In one configuration, the positive displacement pump 14 may take the form of an electric rotary vane-type positive displacement pump, such as, for example, without limitation, the model ESP pump sold by Hale Products Inc. Alternatively, for example, the positive displacement pump 14 may be driven by a clutch drive (not shown) off the centrifugal pump 50 or a gearbox (not shown) of the centrifugal pump 50, in a manner well understood by those of ordinary skill in the art. One advantage of the positive displacement pump 14 is the generation of relatively strong suction/vacuum. The positive displacement pump 14, however, draws between approximately 275 to 300 amps from a power source in order to generate such suction. While not generating as much suction/vacuum as the positive displacement pump 14, one advantage of the venturi 20 is that it utilizes a separate energy source and is quieter to operate than the positive displacement pump 14.

The positive displacement pump 14, operable in a manner well understood by those of ordinary skill in the art, includes a suction inlet port 16, a discharge port 18 and a rotor (not shown) therebetween. The inlet port 16 is fluidly connected with the vacuum port 58 of the centrifugal pump 50 via the vacuum conduit 12. Without operation of the positive displacement pump 14, fluid within the vacuum port 58 is substantially prevented from exiting from the discharge port 18. A power source 28 is electrically connectable to the positive displacement pump 14 for activation thereof. For example, without limitation the power source 28 may take the form of a vehicle battery, such as that of a fire truck, electrically connectable to the positive displacement pump 14 in a manner well understood by those of ordinary skill in the art.

The venturi 20, operative in a manner well understood by those of ordinary skill in the art, also includes an inlet port 22, an outlet port 24 and a suction port 26, fluidly connected in a manner well understood by those of ordinary skill in the art. The suction port 26 is fluidly connectable with the vacuum port 58 of the centrifugal pump 50 via the vacuum conduit 12 in parallel with the inlet port 16 of the positive displacement pump 14. A check valve 30 is positioned upstream, and in line with, the suction port 26 of the venturi 20. As shown in FIG. 1, the check valve 30 is positioned in parallel with the inlet port 16 of the positive displacement pump 14. That is, the check valve 30 is positioned to fluidly connect or disconnect the venturi 20 with the vacuum port 58 of the centrifugal pump 50, without affecting the connectivity of the positive displacement pump 14 with the vacuum port 58 of the centrifugal pump 50. In one configuration, the check valve 30 may take the form of a pressure operated check valve, e.g., a spring-biased check valve or the like, being biased into in a closed position, substantially preventing fluid flow between the vacuum port 58 of the centrifugal pump 50 and the suction port 26 of the venturi 20, and being actuatable to an open position when a pressure differential across the check valve 30 exceeds the cracking pressure thereof (as will be described in further detail below), permitting fluid flow from the vacuum port 58 of the centrifugal pump 50 to the suction port 26 of the venturi 20. Alternatively, the check valve 30 may take the form of a solenoid valve actuatable between open and closed positions independent of the pressure differential across the valve 30. Where a solenoid valve 30 is employed, the solenoid valve 30 is electrically connected with a controller 40 (as will be described in further detail below).

The inlet port 22 of the venturi 20 is fluidly connectable with a source of motive fluid, such as with a compressed air source, e.g., reservoir, 32. For example, without limitation, in emergency services applications, such as priming a centrifugal pump 50 on a fire truck, the compressed air source 32 may emanate from the air brake system of the fire truck. A control valve 34 is positioned upstream and in-line with the venturi inlet port 22, fluidly connected with the compressed air source 32 on an inlet side and fluidly connected with the venturi inlet port 22 on an outlet side. In one configuration, the control valve 34 may take the form of a solenoid valve, but the disclosure is not so limited. For example, without limitation, the control valve 34 may alternatively or additionally take the form of a manually actuatable control valve. The control valve 34 is actuatable between a closed position, substantially fluidly disconnecting the compressed air source 32 from the venturi inlet port 22, and an open position, fluidly connecting the compressed air source 32 with the venturi inlet port 22.

A controller 40 is operatively connected, in a manner well understood by those of ordinary skill in the art, to certain of the components of the dual priming system 10 (as will be described in further detail below) in order to effectuate activation/deactivation of the respective components. The controller 40 may take the form of any suitable controller, currently known or that later becomes known, such as, for example, without limitation, a microprocessor, multiple processors, or the like. The controller 40 may include, or may be operatively coupled to (wired or wirelessly), a user interface (not shown) for sending commands to the controller 40. The user interface may take the form of hardware, software or a combination thereof, for a user to select the desired operation of the dual priming mechanism 10. For example, without limitation, the user interface may take the form of at least one of a touch screen having digital input keys (not shown) and a control panel having physical input keys (not shown). The controller 40 may also include, or may be operatively coupled to, a memory (not shown) that stores the code or software for carrying out the selected operation of the dual priming system 10. The memory may take the form of any known, unknown or otherwise suitable memory device such as a read only memory (ROM) or the like.

The dual priming system 10 is configured to operate in a first, "low load" mode wherein the positive displacement pump 14 is inactive and the venturi 20 is activated, or a second, "high load" mode wherein both the positive displacement pump 14 and the venturi 20 are activated to produce stronger suction power. Advantageously, the dual priming system 10 has the capability of quieter operation in the first mode thereof, i.e., during light duty priming operations, such as, for example, when the reservoir 60 is nearby the centrifugal pump 50 and/or when there is low vertical lift between the reservoir 60 and the centrifugal pump 50. Further advantageously, the dual priming system 10 has the capability of generating greater priming power (than utilizing a positive displacement pump 14 alone) in the second mode thereof, i.e., during heavy duty priming operations, such as, for example, when the reservoir 60 is further from the centrifugal pump 50 and/or when there is greater vertical lift between the reservoir 60 and the centrifugal pump 50. In one configuration, without limitation, operation of the dual priming system 10 in the second mode thereof can prime approximately one and a half times faster than utilizing a positive displacement pump 14 alone. The dual priming system 10 is also configured to switch between operating modes as necessary. For example, the dual priming system 10 may initially operate in the second mode thereof and then switch into the first mode for a predetermined interval after the system is nominally primed. Optionally, the dual priming system 10 may also be configured to operate in a third mode, wherein the positive displacement pump 14 is activated while the venturi 20 is inactive.

The controller 40 is configured to select an optimum mode of operation according to the priming load encountered by the dual priming system 10. Several factors, alone or in combination, may be utilized for the controller 40 to assess low load or high load conditions. For example, the dual priming system 10 may include a sensor 36 positioned proximate the inlet 54 of the centrifugal pump 50, or, alternatively, proximate the vacuum port 58, and operatively connected with the controller 40 and configured to transmit measurements of the vacuum level at the inlet 54 of the centrifugal pump 50 to the controller 40 continuously or at predetermined intervals, e.g., every one, two or five seconds. In one configuration, without limitation, the sensor 36 may take the form of a compound vacuum and pressure transducer. Optionally, the dual priming system 10 may also include at least one of a sensor 42 proximate the suction inlet port 16 of the positive displacement pump 14 and a sensor 44 proximate the suction port 26 of the venturi 20, operatively connected with the controller 40, to transmit additional measurements of vacuum levels to the controller 40.

The controller 40 may be programmed to operate in the first mode at or above a threshold vacuum level and operate in the second mode at or below the threshold vacuum level. Additionally, or alternatively, the controller 40 may be programmed to operate in the first mode at or above a threshold rate of vacuum generation and operate in the second mode at or below the threshold rate of vacuum generation. The threshold vacuum level and the threshold rate of vacuum generation are predetermined according to operating characteristics of the priming devices. As one non-limiting example, if the vacuum level does not increase by 2 inHg within a predetermined time interval, e.g., five or ten seconds of operation in the first mode, the controller 40 may switch the dual priming system 10 into the second mode thereof. Further additionally, or alternatively, the controller 40 may be programmed to operate in the first mode or the second mode according to a number, size and location of the intake(s) 62 being primed, the size (internal volume) of the pump 14, or a combination thereof.

As should be understood by those of ordinary skill in the art, the less intakes 62 being utilized, the smaller the size of the intake(s) 62, or the closer the reservoir 60 to the pump 50, thereby requiring shorter intakes 62, the less the load, i.e., the less gas to evacuate, of the dual priming system 10. The intakes 62 can add significant volume which requires evacuation by the priming system 10, which may be different for each deployment of the pump 50. In applications where the reservoir 60 is further away from the centrifugal pump 50, requiring longer or more intakes 62, the controller 40 may activate both the positive displacement pump 14 and the venturi 20 to match the load, i.e., the priming system 10 may operate in a second mode, as described below. In certain applications, a portable folding tank (not shown), such as those manufactured by the Fol-Da-Tank® Company may be placed proximate to the centrifugal pump 50, shortening the intake 62 between the tank and the pump 50 and reducing the priming load compared to a natural static water source, such as a pond, which may be further away from the pump 50, thereby requiring a longer intake 62 or multiple intakes 62. In the situation of lower load or less gas to evacuate, the requisite vacuum will generate more quickly. The controller 40 may also include a manual mode, or a manual override mode, selectable via the user interface, wherein a user can manually select the mode of operation of the dual priming system 10.

In operation, the dual priming system 10 may initially power on in either the first mode or the second mode, e.g., according to a user specified setting. In the first mode, the controller 40 actuates the control valve 34 (operatively connected thereto) into the open position thereof, thereby permitting the compressed air from the compressed air source 32 to flow into the venturi 20 via the inlet port 22, and, in turn, generate a vacuum at the suction port 26. Where a pressure operated check valve 30 is employed, the check valve 30 is actuated into the open position thereof once a pressure differential across the check valve 30 is greater than the cracking pressure thereof. Where a solenoid type check valve 30, operatively connected to the controller 40, is employed, the controller 40 also actuates the check valve 30 into the open position thereof. The suction port 26 of the venturi 20 is thereby fluidly connected with the vacuum port 58 of the centrifugal pump 50 via the vacuum conduit 12 to suction and evacuate gas from the centrifugal pump casing 52 and draw liquid from the reservoir 60 into the centrifugal pump casing 52.

In the second mode, the controller 40 also connects the power source 28 with the positive displacement pump 14 (in a manner well understood by those of ordinary skill in the art, e.g., via activating a switch) to activate the pump 14. Operation of the pump 14 suctions and evacuates gas from the centrifugal pump casing 52 in parallel with the venturi 20, thereby resulting in greater and faster priming. When switching from the second mode to the first mode, the controller 40 disconnects the power source 28 from the positive displacement pump 14. To switch off the venturi 20, the controller 40 actuates the control valve 34 into the closed position thereof. As should be understood by those of ordinary skill in the art, the dual priming system 10 may alternatively initially operate in the third mode, and, thereafter switch into the first or second modes.

Figure 2:
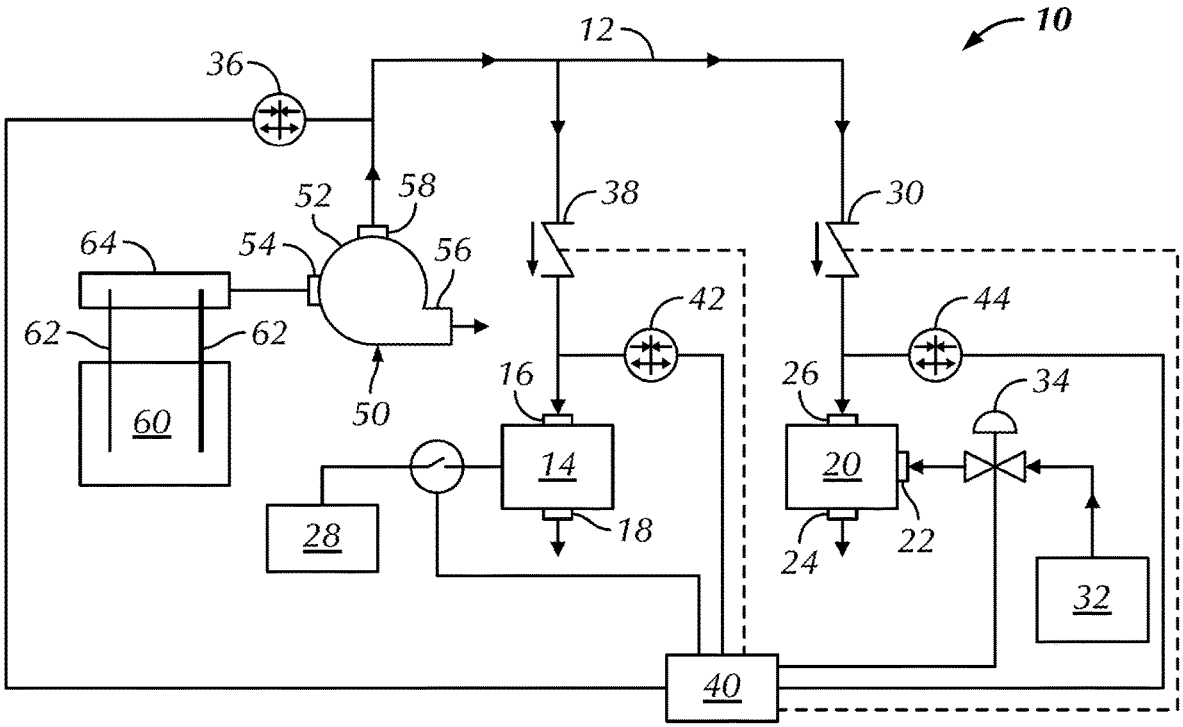
FIG. 2 is a schematic illustration of a dual priming system according to an alternative embodiment of the present disclosure.

Optionally, as shown in FIG. 2, the dual priming system 10 may also include a second check valve 38 positioned upstream, and in line with, the suction inlet port 16 of the positive displacement pump 14. The check valve 38 is positioned in parallel with the check valve 30. Similarly to the check valve 30, the check valve 38 is positioned to fluidly connect or disconnect the positive displacement pump 14 with the vacuum port 58 of the centrifugal pump 50. In one configuration, the check valve 38 may take the form of a pressure operated check valve, e.g., a spring-biased check valve or the like, being biased into in a closed position, substantially preventing fluid flow between the vacuum port 58 of the centrifugal pump 50 and the suction inlet port 16 of the positive displacement pump 14, and being actuatable to an open position when a pressure differential across the check valve 38 exceeds the cracking pressure thereof, permitting fluid flow from the vacuum port 58 of the centrifugal pump 50 to the suction inlet port 16 of the positive displacement pump 14. Alternatively, the check valve 38 may take the form of a solenoid valve actuatable between open and closed positions independent of the pressure differential across the valve 38.

In operation, and where a pressure operated check valve 38 is employed, the check valve 38 is actuated into the open position thereof when the controller 40 connects the power source 28 with the positive displacement pump 14 to activate the pump 14, and, in turn, the pump 14 generates a pressure differential across the check valve 38 that is greater than the cracking pressure thereof. Where a solenoid type check valve 38 (operatively connected to the controller 40) is employed, the controller 40 actuates the check valve 38 into the open position thereof in addition to connecting the power source 28 with the positive displacement pump 14 to activate the pump 14. The suction inlet port 16 of the positive displacement pump 14 is thereby fluidly connected with the vacuum port 58 of the centrifugal pump 50 via the vacuum conduit 12 to suction and evacuate gas from the centrifugal pump casing 52 and draw liquid from the reservoir 60 into the centrifugal pump casing 52.

It will be appreciated by those skilled in the art that changes could be made to the embodiments described above without departing from the broad inventive concepts thereof. It is understood, therefore, that this invention is not limited to the particular embodiments disclosed, but it is intended to cover modifications within the spirit and scope of the present disclosure, as set forth in the appended claims.

We claim:

1. A pump system comprising: a centrifugal pump defining a casing with an inlet, an outlet and a vacuum port, the inlet being fluidly connectable with a liquid containing reservoir; and a dual priming system connected with the vacuum port of the centrifugal pump, the dual priming system comprising: a compressed air source; a positive displacement pump having an inlet port and a discharge port, the inlet port being fluidly connected with the vacuum port of the centrifugal pump, whereby selective activation of the positive displacement pump is configured to evacuate gas from the centrifugal pump casing through the vacuum port and into the inlet port of the positive displacement pump and, in turn, draw liquid from the reservoir and into the centrifugal pump casing; a venturi having a lower maximum vacuum generation capability than the positive displacement pump, the venturi having an inlet port, an outlet port and a suction port, the inlet port being fluidly connectable with the compressed air source and the suction port being fluidly connectable with the vacuum port of the centrifugal pump in parallel with the inlet port of the positive displacement pump, whereby selective activation of the venturi pump is configured to evacuate the gas from the centrifugal pump casing and into the suction port of the venturi and, in turn, draw the liquid from the reservoir and into the centrifugal pump casing; a check valve positioned upstream and in line with the suction port of the venturi and positioned in parallel with the inlet port of the positive displacement pump, the check valve being oriented in a closed position, substantially preventing fluid flow between the vacuum port of the centrifugal pump and the suction port of the venturi, and actuatable to an open position, permitting fluid flow from the vacuum port of the centrifugal pump to the suction port of the venturi; and a control valve positioned upstream and in-line with the venturi inlet port, the control valve having an inlet fluidly connected with the compressed air source and an outlet fluidly connected with the venturi inlet port, the control valve being actuatable between a closed position, substantially fluidly disconnecting the compressed air source from the venturi, and an open position, fluidly connecting the compressed air source with the venturi inlet port; the dual priming system being operational in a first mode, wherein the positive displacement pump is inactive and the venturi is activated, and a second mode, wherein the positive displacement pump is activated and the venturi is activated.

2. The pump system of claim 1, wherein the dual priming system is further operational in a third mode wherein the positive displacement pump is activated and the venturi is inactive.

3. The pump system of claim 1, wherein orientation of the control valve into the open position thereof is configured to permit compressed air to flow into the inlet port of the venturi, thereby creating a vacuum at the suction port, and, in turn actuating the check valve into the open position thereof.

4. The pump system of claim 1, further comprising a power source connectable to the positive displacement pump for activation thereof.

5. The pump system of claim 4, wherein the power source comprises a vehicle battery.

6. The pump system of claim 1, wherein the compressed air source is part of an automotive air brake system.

7. The pump system of claim 1, wherein the positive displacement pump is an electric rotary vane-type positive displacement pump.

8. A pump system comprising: a centrifugal pump defining a casing with an inlet, an outlet and a vacuum port, the inlet being fluidly connectable with a liquid containing reservoir; and a dual priming system connected with the vacuum port of the centrifugal pump, the dual priming system comprising: a compressed air source; a positive displacement pump having an inlet port and a discharge port, the inlet port being fluidly connectable with the vacuum port of the centrifugal pump, whereby selective activation of the positive displacement pump is configured to evacuate gas from the centrifugal pump casing through the vacuum port and into the inlet port of the positive displacement pump and, in turn, draw liquid from the reservoir and into the centrifugal pump casing; a venturi having a lower maximum vacuum generation capability than the positive displacement pump, the venturi having an inlet port, an outlet port and a suction port, the inlet port being fluidly connectable with the compressed air source and the suction port being fluidly connectable with the vacuum port of the centrifugal pump in parallel with the inlet port of the positive displacement pump, whereby selective activation of the venturi pump is configured to evacuate the gas from the centrifugal pump casing and into the suction port of the venturi and, in turn, draw the liquid from the reservoir and into the centrifugal pump casing; a first check valve positioned upstream and in line with the suction port of the venturi and positioned in parallel with the inlet port of the positive displacement pump, the first check valve being oriented in a closed position, substantially preventing fluid flow between the vacuum port of the centrifugal pump and the suction port of the venturi, and actuatable to an open position, permitting fluid flow from the vacuum port of the centrifugal pump to the suction port of the venturi; a second check valve positioned upstream and in line with the inlet port of the positive displacement pump and positioned in parallel with the first check valve, the second check valve being oriented in a closed position, substantially preventing fluid flow between the vacuum port of the centrifugal pump and the inlet port of the positive displacement pump, and actuatable to an open position, permitting fluid flow from the vacuum port of the centrifugal pump to the inlet port of the positive displacement pump; and a control valve positioned upstream and in-line with the venturi inlet port, the control valve having an inlet fluidly connected with the compressed air source and an outlet fluidly connected with the venturi inlet port, the control valve being actuatable between a closed position, substantially fluidly disconnecting the compressed air source from the venturi, and an open position, fluidly connecting the compressed air source with the venturi inlet port; the dual priming system being operational in a first mode, wherein the positive displacement pump is inactive and the venturi is activated, and a second mode, wherein the positive displacement pump is activated and the venturi is activated.

9. The pump system of claim 8, wherein the positive displacement pump is an electric rotary vane-type positive displacement pump.

10. A method of priming a centrifugal pump defining a casing with an inlet, an outlet and a vacuum port, the inlet being fluidly connectable with a liquid containing reservoir, the method comprising: connecting a dual priming system with the vacuum port of the centrifugal pump, the dual priming system comprising: a compressed air source; a positive displacement pump having an inlet port and a discharge port, the inlet port being fluidly connectable with the vacuum port of the centrifugal pump; a venturi having a lower maximum vacuum generation capability than the positive displacement pump, the venturi having an inlet port, an outlet port and a suction port, the inlet port being fluidly connectable with the compressed air source and the suction port being fluidly connectable with the vacuum port of the centrifugal pump in parallel with the inlet port of the positive displacement pump; a first check valve positioned upstream and in line with the suction port of the venturi and positioned in parallel with the inlet port of the positive displacement pump, the first check valve being oriented in a closed position, substantially preventing fluid flow between the vacuum port of the centrifugal pump and the suction port of the venturi, and actuatable to an open position, permitting fluid flow from the vacuum port of the centrifugal pump to the suction port of the venturi; a second check valve positioned upstream and in line with the inlet port of the positive displacement pump and positioned in parallel with the first check valve, the second check valve being oriented in a closed position, substantially preventing fluid flow between the vacuum port of the centrifugal pump and the inlet port of the positive displacement pump, and actuatable to an open position, permitting fluid flow from the vacuum port of the centrifugal pump to the inlet port of the positive displacement pump; and a control valve positioned upstream and in-line with the venturi inlet port, the control valve having an inlet fluidly connected with the compressed air source and an outlet fluidly connected with the venturi inlet port, the control valve being actuatable between a closed position, substantially fluidly disconnecting the compressed air source from the venturi, and an open position, fluidly connecting the compressed air source with the venturi inlet port; actuating the control valve into the open position thereof to fluidly connect the compressed air source with the venturi inlet port to permit compressed air to flow into the inlet port of the venturi, and, in turn, creating a vacuum at the suction port; and actuating the first check valve into the open position thereof to fluidly connect the vacuum port of the centrifugal pump with the suction port of the venturi, and, in turn, evacuating gas from the centrifugal pump casing and into the suction port of the venturi, thereby drawing liquid from the reservoir and into the centrifugal pump casing.

11. The method of claim 10, further comprising the steps of:

powering the positive displacement pump; and actuating the second check valve into the open position thereof to fluidly connect the vacuum port of the centrifugal pump with the inlet port of the positive displacement pump to also evacuate gas from the centrifugal pump casing.

12. The method of claim 11, wherein the powering step comprises electrically connecting a vehicle battery with the positive displacement pump.

* * * * *